US008022629B2

(12) United States Patent
Lim

(10) Patent No.: US 8,022,629 B2
(45) Date of Patent: Sep. 20, 2011

(54) PLASMA DISPLAY PANEL AND METHOD FOR MANUFACTURING THE SAME

(75) Inventor: Jong Rae Lim, Anyang-si (KR)

(73) Assignee: LG Electronics Inc., Seoul (KR)

( * ) Notice: Subject to any disclaimer, the term of this patent is extended or adjusted under 35 U.S.C. 154(b) by 805 days.

(21) Appl. No.: 12/056,850

(22) Filed: Mar. 27, 2008

(65) Prior Publication Data

US 2008/0259003 A1 Oct. 23, 2008

(30) Foreign Application Priority Data

Apr. 6, 2007 (KR) ..... 10-2007-0033960

(51) Int. Cl.
*H01J 17/49* (2006.01)

(52) U.S. Cl. ..... 313/586; 313/582; 313/587; 445/24

(58) Field of Classification Search ..... 313/582–587; 445/24

See application file for complete search history.

(56) References Cited

U.S. PATENT DOCUMENTS

| | | | | |
|---|---|---|---|---|
| 2003/0146886 | A1* | 8/2003 | Amatsuchi | 345/62 |
| 2005/0082981 | A1* | 4/2005 | Jang et al. | 313/587 |
| 2005/0099126 | A1* | 5/2005 | Kim et al. | 313/586 |
| 2005/0140300 | A1* | 6/2005 | Park | 313/586 |
| 2006/0232206 | A1* | 10/2006 | Seo | 313/582 |

* cited by examiner

*Primary Examiner* — Bumsuk Won
(74) *Attorney, Agent, or Firm* — KED & Associates, LLP

(57) ABSTRACT

A plasma display panel having a dielectric with a stepped structure and a method for manufacturing the same are disclosed. The plasma display panel includes a first panel comprising a plurality of electrode pairs each including a scan electrode and a sustain electrode, and a dielectric layer formed over the electrode pairs, a second panel comprising a plurality of address electrodes arranged to cross the plurality of electrode pairs, and barrier ribs formed on the second substrate, to define discharge cells. The dielectric layer includes recesses respectively arranged between two electrodes arranged in each discharge cell and between two electrodes arranged adjacent to each other at opposite sides of each barrier rib.

19 Claims, 10 Drawing Sheets

PLASMA DISPLAY PANEL AND METHOD FOR MANUFACTURING THE SAME

This application claims the benefit of Korean Patent Application No. 10-2007-0033960, filed on Apr. 6, 2007, which is hereby incorporated by reference as if fully set forth herein.

BACKGROUND OF THE INVENTION

1. Field of the Invention

The present invention relates to a plasma display panel, and more particularly, to a plasma display panel having a dielectric with a stepped structure and a method for manufacturing the same.

2. Discussion of the Related Art

In accordance with the advent of an age of multimedia, development of a display device capable of more finely rendering colors more approximate to natural colors while having a larger size is being required.

However, the current cathode ray tubes (CRTs) have a limitation in realizing a large screen of 40 inches or more. For this reason, liquid crystal displays (LCDs), plasma display panels (PDPs), and projection televisions (TVs) are being rapidly developed so that the applications thereof can be extended to a high-quality image field.

PDPs are known as an electronic appliance to display an image, using plasma discharge. In such a PDP, a certain voltage is applied between electrodes in a discharge space defined in the PDP, to generate plasma discharge in the discharge space. A phosphor layer having a certain pattern is excited by vacuum ultraviolet rays (VUVs) generated during the plasma discharge, to produce an image.

Generally, such a PDP, which operates in the above-mentioned manner, has a long gap structure, in which a scan electrode and a sustain electrode are spaced apart from each other by a long distance, in order to increase a discharge area.

However, where the distance between the scan electrode and the sustain electrode is long, there may be problems of an increase in discharge initiation voltage and unstable discharge. Furthermore, self erase may occur during a sustain discharge operation.

SUMMARY OF THE INVENTION

Accordingly, the present invention is directed to a plasma display panel and a method for manufacturing the same that substantially obviate one or more problems due to limitations and disadvantages of the related art.

An object of the present invention is to provide a plasma display panel including a dielectric having a stepped structure to achieve stable discharge and a reduction in discharge initiation voltage, and a method for manufacturing the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma display panel comprises: a first panel comprising a plurality of electrode pairs each including a scan electrode and a sustain electrode, and a dielectric layer formed over the electrode pairs; a second panel comprising a plurality of address electrodes arranged to cross the plurality of electrode pairs; and barrier ribs formed on the second substrate, to define discharge cells, wherein the dielectric layer includes recesses respectively arranged between two electrodes arranged in each discharge cell and between two electrodes arranged adjacent to each other at opposite sides of each barrier rib.

The scan electrode and the sustain electrode in each discharge cell may be spaced apart from each other by a distance longer than a distance between the scan electrode and an associated one of the address electrodes.

The recess arranged over each barrier rib may have a size larger than a size of the recess arranged in each discharge cell. Each recess may have a maximum depth corresponding to ⅔ of a total thickness of the dielectric layer.

In another aspect of the present invention, a method for manufacturing a plasma display panel comprises: preparing a first panel including a plurality of electrode pairs each including a scan electrode and a sustain electrode, and preparing a second panel including address electrodes, barrier ribs defining discharge cells, and phosphor layers; forming a dielectric layer over the first panel such that the dielectric layer covers the plurality of electrode pairs; pattering the dielectric layer, to form a first recess between the scan electrode and the sustain electrode included in each of the electrode pairs, and a second recess between adjacent ones of the electrode pairs; and assembling the first panel and the second panel such that the first recess faces an associated one of the discharge cells, and the second recess faces an associated one of the barrier ribs.

The dielectric layer may have a multilayer structure comprising a first dielectric layer and a second dielectric layer. The first dielectric layer may comprise dielectric powder, a high-molecular organic compound indissoluble in a developing solution, a dispersing agent, and a plasticizer. The second dielectric layer comprises photosensitive dielectric powder, a high-molecular organic compound dissoluble in a developing solution, a dispersing agent, and a plasticizer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Hereinafter, configurations and operations according to the present invention will be described in detail in conjunction with embodiments of a plasma display panel (PDP) according to the present invention. Although the configurations and functions of the present invention are illustrated in the accompanying drawings, in conjunction with at least one embodiment, and described with reference to the accompanying drawings and the embodiment, the technical idea of the present invention and the important configurations and functions thereof are not limited thereto.

Figure 1:
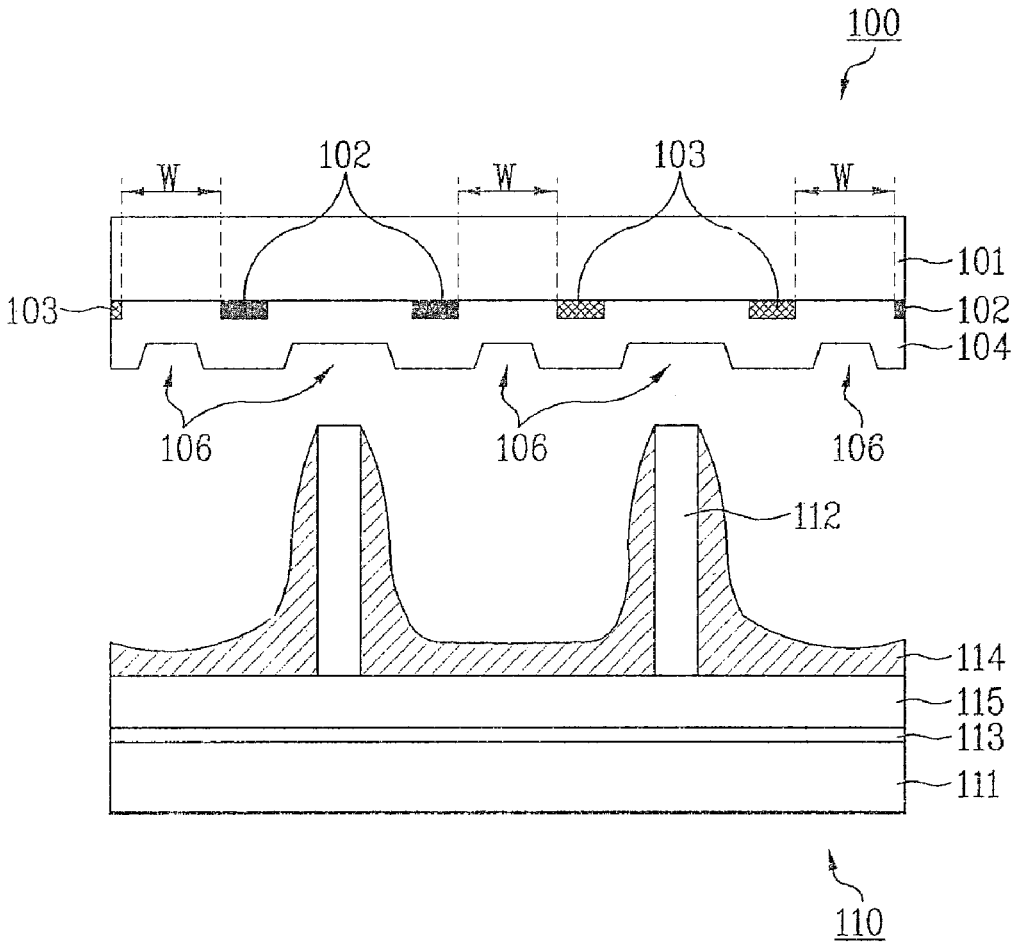
FIG. 1 is a view illustrating a first embodiment of a plasma display panel (PDP) according to the present invention.

FIG. 1 is a sectional view illustrating a PDP according to a first embodiment of the present invention. As shown in FIG. 1, the PDP mainly includes a front panel 100 and a back panel 110.

The front panel 100 includes a first substrate 101, and a plurality of electrode pairs formed on the first substrate 101 to extend in one direction. Each electrode pair includes a scan electrode 102 and a sustain electrode 103.

The first substrate 101 is prepared by machining a glass for a display substrate, using milling, cleaning, etc.

Typically, each electrode pair may be made of indium tin oxide (ITO) or metal.

Preferably, metal electrodes are used. The reason why metal electrodes are used is that the metal electrodes can be more simply and inexpensively manufactured, as compared to ITO electrodes.

If necessary, a bus electrode may be formed on each scan electrode 102 and each sustain electrode 103.

Each electrode pair may be formed in accordance with a photo-etching method using a sputtering process or a lift-off method using a chemical vapor deposition (CVD) process. The bus electrodes may be made of a material comprising a general-purpose conductive metal and a rare metal.

The general-purpose conductive metal may include aluminum (Al), copper (Cu), nickel (Ni), chromium (Cr), and molybdenum (Mo). On the other hand, the rare metal may include silver (Ag), gold (Au), platinum (Pt), and iridium (Ir).

When the general-purpose conductive metal and rare metal are mixed to prepare the material of the bus electrodes, the general-purpose conductive metal forms a core such that the rare metal encloses the core.

As shown in FIG. 1, one of two electrodes arranged in each discharge cell may be a scan electrode 102, and the other may be a sustain electrode 103. The electrode arranged adjacent to the scan electrode 102 of the discharge cell via a barrier rib 112 of the discharge cell may be the scan electrode 102 of another discharge cell. The electrode arranged adjacent to the sustain electrode 103 of the discharge cell via the barrier rib 112 of the discharge cell may be the sustain electrode 103 of another discharge cell.

That is, at the left side of the scan electrode 102 in each discharge cell, another scan electrode 102 is arranged. At the right side of the scan electrode 102 in the discharge cell, the sustain electrode 103 of the discharge cell is arranged. At the left side of the sustain electrode 103 in the discharge cell, the scan electrode 102 of the discharge cell is arranged. At the right side of the sustain electrode 103 in the discharge cell, another sustain electrode 103 is arranged.

It is preferred that the distance between the scan electrode 102 and the sustain electrode 103 in each discharge cell be longer than the distance between the scan electrode 102 and an associated address electrode 113.

This is because it is possible to achieve an increase in discharge area when the distance between the scan electrode 102 and the address electrode 113 increases.

In accordance with the present invention, the distance W between the scan electrode 102 and the sustain electrode 103 in each discharge cell is preferably about 150 to 400 μm.

More preferably, the distance W between the scan electrode 102 and the sustain electrode 103 in each discharge cell is about 300 μm. The distance between the scan electrode 102 and the sustain electrode 103 in each discharge cell may also be about 200 μm.

A dielectric layer 104 is formed over the overall surface of the first substrate 101 including the electrode pairs.

The dielectric layer 104 has recesses 106 respectively formed between two electrodes arranged in each discharge cell and between two electrodes arranged adjacent to each other at opposite sides of the barrier rib 112 of each discharge cell.

Each recess 106 may have various cross-sectional shapes. For example, each recess 106 may have a taper shape, an arch shape, a rectangular shape, or a stepped shape.

The taper shape is a shape in which the width of the recess 106 decreases linearly as the recess 106 extends upwardly. The arch shape is a shape in which the width of the recess 106 decreases at a gradually-increasing rate as the recess 106 extends upwardly. The rectangular shape is a shape in which the width of the recess 106 is uniform. On the other hand, the stepped shape is a shape in which the width of the recess 106 decreases stepwise.

It is preferred that the width of the recess 106 formed over the barrier rib 112 be larger than the width of the recess 106 formed in the discharge cell.

In this case, it is possible to achieve a reduction in discharge initiation voltage because a discharge path may be formed between the electrodes of adjacent discharge cells, so that an increase in discharge path length is achieved, thereby achieving an enhancement in efficiency and preventing unstable discharge involving self erase, etc.

The width of each recess 106 may be smaller than or equal to the distance between two electrodes arranged in each discharge cell or the distance between two electrodes arranged adjacent to each other at opposite sides of the barrier rib of each discharge cell.

Preferably, each recess 106 has a maximum depth corresponding to ⅔ of the total thickness of the dielectric layer 104. The recess 106 may have a depth of about 20 to 30 μm.

This is because the dielectric layer 104 cannot perform a desired dielectric function when the recess 106 is excessively deep, thereby causing a reduction in discharge efficiency and a reduction in electrode lifespan.

On the other hand, when the recess 106 is excessively shallow, it is impossible to arrange the scan electrode and the sustain electrode such that the distance between the scan electrode and the sustain electrode is sufficiently long. In this case, it is impossible to achieve a reduction in discharge initiation voltage.

Over the dielectric layer 104 formed with the recesses 106, a passivation film made of magnesium oxide (MgO), etc. may be formed to relax discharge conditions.

The passivation film functions to protect the dielectric layer 104 from an impact of positive (+) ions during an electrical discharge, while functioning to increase the emission of secondary electrons.

The PDP further includes a back panel 110. The back panel 110 includes a second substrate 111. Address electrodes 113 are formed on the second substrate 111 such that they extend in a direction perpendicular to the extension direction of the electrode pairs on the first substrate 101.

A white dielectric layer 115 is also formed over the overall surface of the second substrate 111 including the address electrodes 113.

The address electrodes 113 may be made of a material comprising conductive metal and rare metal. The conductive metal may include aluminum (Al), copper (Cu), nickel (Ni), chromium (Cr), and molybdenum (Mo). On the other hand, the rare metal may include silver (Ag), gold (Au), platinum (Pt), and iridium (Ir).

The formation of the white dielectric layer 115 may be achieved by coating a material of the white dielectric layer 115, using a printing method or a film laminating method, and then curing the coated material. Barrier ribs 112 are formed on the white dielectric layer 115 such that each barrier rib 112 is arranged between the adjacent address electrodes 113.

The barrier ribs 112 may be of a stripe type, a well type, or a delta type.

The barrier ribs 112 are made of a material comprising a parent glass and a porous filler. The parent glass may include a lead-based parent glass or and a lead-free parent glass. The lead-based parent glass may include ZnO, PbO, or $B_2O_3$. On the other hand, the lead-free parent glass may include ZnO, $B_2O_3$, BaO, SrO, or CaO.

The filler may include an oxide such as $SiO_2$ or $Al_2O_3$. Although not shown, a black top may be formed on each barrier rib 112.

Red (R), green (G), and blue (B) phosphor layers 114 are formed on the white dielectric layer 115.

In order to minimize the discharge initiation voltage difference among R, G, and B discharge cells, each of the R, G, and B phosphor layers 114 is made of a material comprising a phosphor and a dielectric having a secondary electron emission coefficient higher than that of the phosphor.

For the phosphor, any of a blue phosphor, a green phosphor, and a red phosphor may be used.

For the red phosphor, $Y(V,P)O_4$:Eu or $(Y,Gd)BO_3$:Eu may be used. For the green phosphor, a material selected from the group consisting of $Zn_2SiO_4$:Mn, $(Zn, A)_2SiO_4$:Mn ("A" is an alkali metal), and a mixture thereof may be used.

Also, a mixture of the green phosphor with at least one phosphor selected from the group consisting of $BaAl_{12}O_{19}$:Mn, $(Ba,Sr,Mg)O_{\alpha}Al_2O_3$:Mn ("a" is a natural number of 1 to 23), $MgAl_xO_y$:Mn (x=1 to 10, and y=1 to 30), $LaMgAl_xO_y$:Tb,Mn (x=1 to 14, and y=8 to 47), and $ReBO_3$:Tb ("Re" is at least one rare earth element selected from the group consisting of Sc, Y, La, Ce, and Gd) may be used.

For the blue phosphor, $BaMgAl_{10}O_{17}$:Eu, $CaMgSi_2O_6$:Eu, $CaWO_4$:Pb, $Y_2SiO_5$:Eu, or a mixture thereof may be used.

The formation of the phosphor layers 114 may be achieved by preparing a phosphor paste, coating the prepared phosphor paste in each discharge cell, drying the coating, and curing the dried coating.

The coating of the phosphor layers 114 may be achieved, selectively using a screen printing method, a doctor blade method, a dip method, a reverse roll method, a direct roll method, a gravure method, an extrusion method, a brush method, etc. The screen printing method is preferable.

The drying process for the phosphor layers 114 may be carried out at a temperature of about 50 to 250° C. for about 5 to 90 minutes. The curing process may be carried out in a vacuum or in a reducing atmosphere containing inert gas at a temperature of about 300 to 600° C. for about 30 to 60 minutes.

More preferably, the curing process is carried out at a low temperature of about 400 to 550° C. for about 30 to 60 minutes.

When the curing temperature is excessively low, or the curing time is excessively short, it is difficult to remove residual organic substances from the phosphor layers 114. On the other hand, when the curing temperature is excessively high, or the curing time is excessively long, the phosphor layers 114 may be degraded.

After the formation of the phosphor layers 114 in the above-described manner, the front panel 100 and back panel 110 are assembled to each other such that the barrier ribs 112 are interposed between the front panel 100 and the back panel 110. The assembly of the panels is achieved by a sealant provided along the peripheries of the front and back panels 100 and 110.

The front and back panels 100 and 110, which are manufactured as described above, are connected to a driver.

Figure 2:
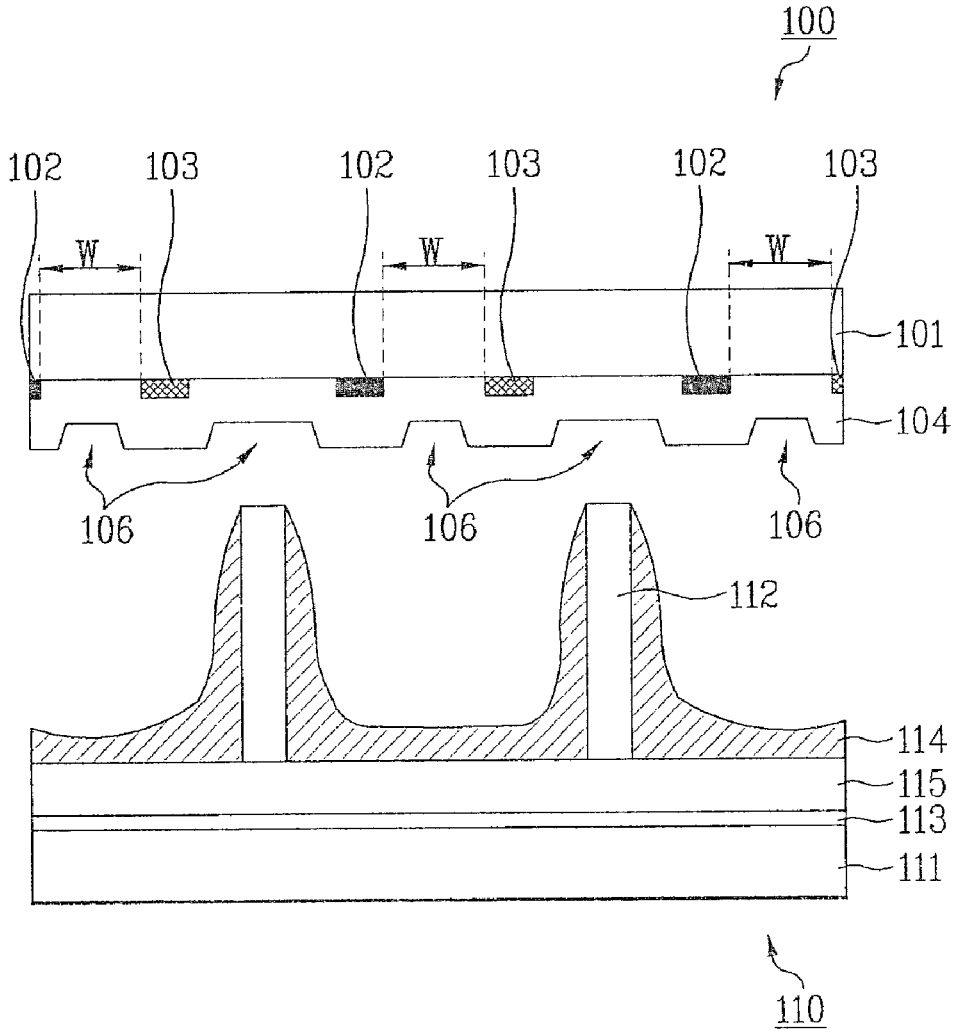
FIG. 2 is a view illustrating a second embodiment of the PDP according to the present invention.

FIG. 2 is a sectional view illustrating a PDP according to a second embodiment of the present invention. As shown in FIG. 2, the basic structure of the PDP according to this embodiment is similar to that of the first embodiment.

In the second embodiment of the present invention, one of two electrodes arranged in each discharge cell may be a scan electrode 102, and the other may be a sustain electrode 103. The electrode arranged adjacent to the scan electrode 102 of the discharge cell via a barrier rib 112 of the discharge cell may be the sustain electrode 103 of another discharge cell. The electrode arranged adjacent to the sustain electrode 103 of the discharge cell via the barrier rib 112 of the discharge cell may be the scan electrode 102 of another discharge cell.

That is, at the left and right sides of the scan electrode 102 in each discharge cell, only the sustain electrodes 103 are arranged, respectively. At the left and right sides of the sustain electrode 103 in the discharge cell, only the scan electrodes 102 are arranged, respectively.

A dielectric layer 104 is formed over the overall surface of the first substrate 101 including the electrode pairs. The dielectric layer 104 has recesses 106 respectively formed between two electrodes arranged in each discharge cell and between two electrodes arranged adjacent to each other at opposite sides of the barrier rib 112 of each discharge cell.

It is preferred that the width of the recess 106 formed over the barrier rib 112 be larger than the width of the recess 106 formed in the discharge cell.

In this case, it is possible to achieve a reduction in discharge initiation voltage because a discharge path may be formed between the electrodes of adjacent discharge cells, so that an increase in discharge path length is achieved, thereby achieving an enhancement in efficiency and preventing unstable discharge involving self erase, etc.

The width of each recess 106 may be smaller than or equal to the distance between two electrodes arranged in each discharge cell or the distance between two electrodes arranged adjacent to each other at opposite sides of the barrier rib of each discharge cell.

Preferably, each recess 106 has a maximum depth corresponding to ⅔ of the total thickness of the dielectric layer 104. The recess 106 may have a depth of about 20 to 30 μm.

Figure 3:
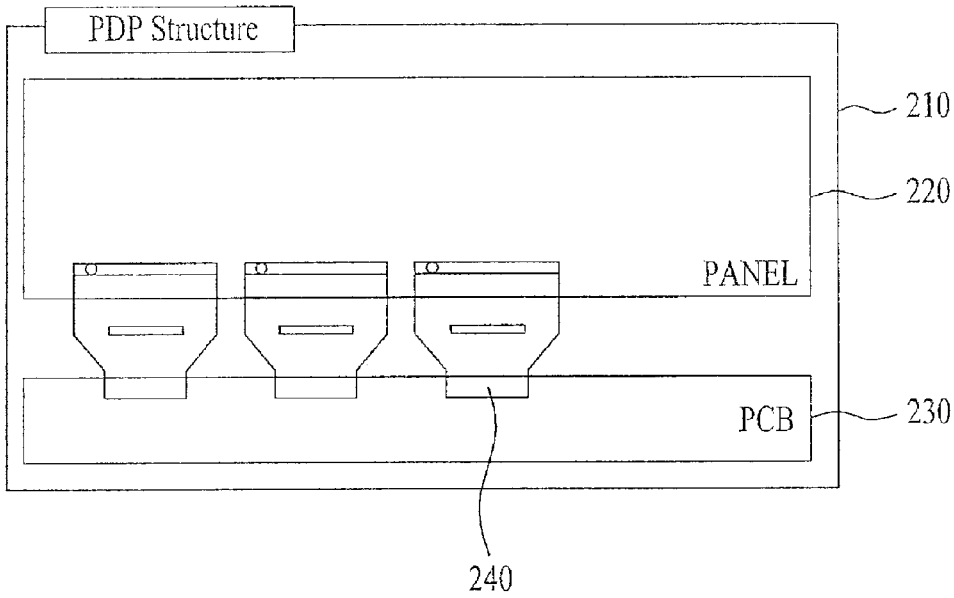
FIG. 3 is a view illustrating a driver circuit and connectors in the PDP according to the present invention.

FIG. 3 is a view illustrating a driver circuit and connectors in the PDP according to the present invention.

As shown in FIG. 3, the PDP includes a panel 220, a driver board 230 to supply a drive voltage to the panel 220, and tape carrier packages (TCPs) 240 to connect the electrodes of cells included in the panel 220 to the driver board 230. Each TCP comprises a flexible board. The driver board 230 may comprise a printed circuit board (PCB), as shown in FIG. 3.

As described above, the panel 220 includes a front panel, a back panel, and barrier ribs.

The electrical and physical connection between the panel 220 and each TCP 240 and the electrical and physical connections between each TCP 240 and the driver board 230 are achieved using anisotropic conductive films (ACFs). Each ACF is a conductive resin film formed using a nickel ball coated with gold (Au).

Figure 4:
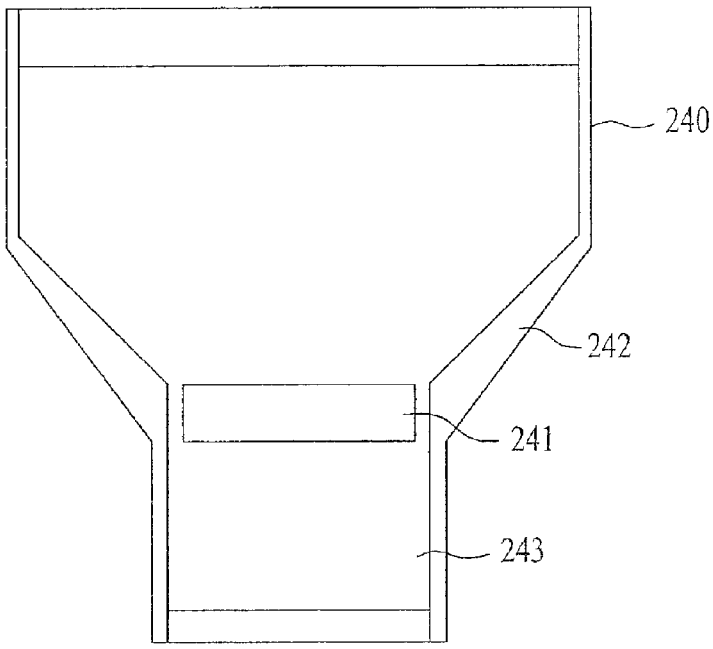
FIG. 4 is a view illustrating a wiring structure of a tape carrier package (TCP)

FIG. 4 is a view illustrating a wiring structure of one TCP.

As shown in FIG. 4, the TCP 240, which functions to connect the panel 220 and the driver board 230, includes a flexible substrate 242, wirings 243 densely arranged on the flexible substrate 242, and a driver chip 241 connected to the wirings, to receive electric power from the driver board 230 and to supply the received electric power to a selected one of the associated electrodes of the panel 220.

The driver chip 241 has a configuration to receive a small number of voltages and a small number of drive control signals and to alternately output a large number of high-power signals. For this reason, the number of the wirings 243 connected to the driver board 230 is small, whereas the number of the wirings 243 connected to the panel 220 is large.

Although the wirings 243 are divided with respect to the driver chip 241 in the illustrated case, they may not be divided with respect to the driver chip 241 because the wiring connection for the driver chip 241 may be achieved, using a space provided at the driver board 230.

Figure 5:
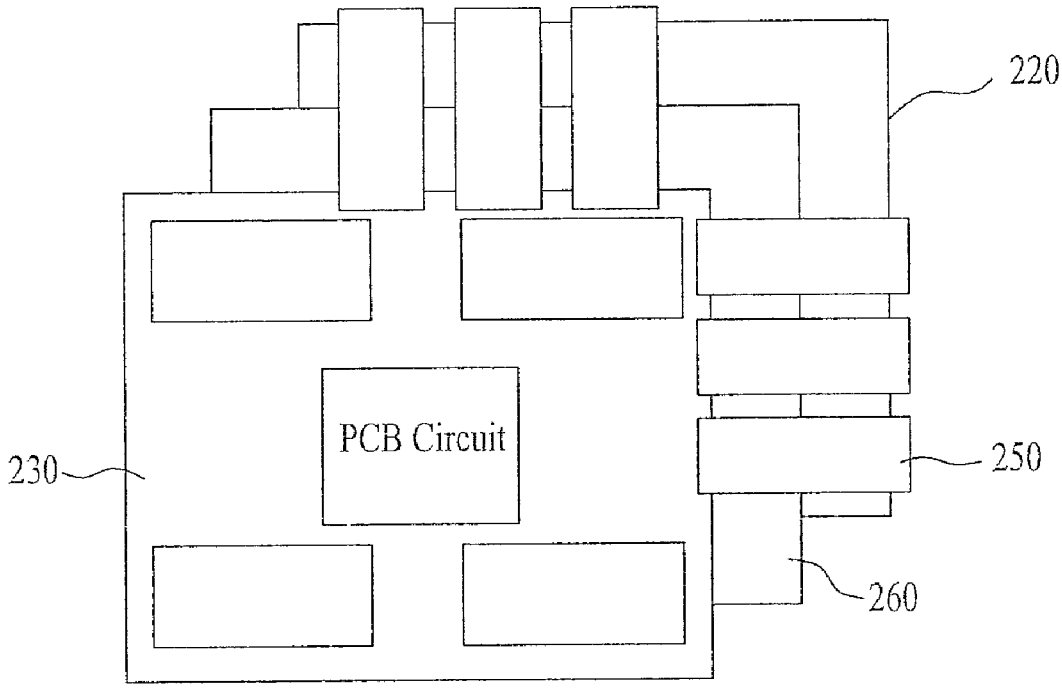
FIG. 5 is a view schematically illustrating an embodiment different from that of FIG. 4.

FIG. 5 is a view schematically illustrating an embodiment different from that of FIG. 4.

In this embodiment, the panel 220 is connected with a driver circuit via a flexible printed circuit (FPC) 250.

The FPC 250 comprises a film made of polyimide, and formed with a certain pattern. In this embodiment, the FPC 250 and panel 220 are connected via an ACF.

As in the previous embodiment, the driver board 230 comprises a PCB.

The driver circuit includes a data driver, a scan driver, and a sustain driver. The data driver is connected to the address electrodes, to apply a data pulse to the address electrodes. The scan driver is connected to the scan electrodes, to supply a ramp-up signal, a ramp-down signal, a scan pulse, and a sustain pulse to the scan electrodes.

The sustain driver applies a sustain pulse and a DC voltage to a common sustain electrode.

The PDP operates in a driving period divided into a reset period, an address period, and a sustain period.

In the reset period, the ramp-up signal is applied to the scan electrodes in a simultaneous manner. In the address period, a negative scan pulse is applied to the scan electrodes in a sequential manner. In synchronism with the scan pulse, a positive data pulse is applied to the address electrodes.

In the sustain period, a sustain pulse is applied to the scan electrodes and sustain electrodes in an alternating manner.

FIGS. 6A to 6J are views illustrating an exemplary embodiment of a method for manufacturing the PDP according to the present invention.

Hereinafter, the PDP manufacturing method according to the present invention will be described with reference to FIGS. 6A to 6J.

The PDP of the present invention mainly includes a front panel 100 and a back panel 110.

Figure 6A:
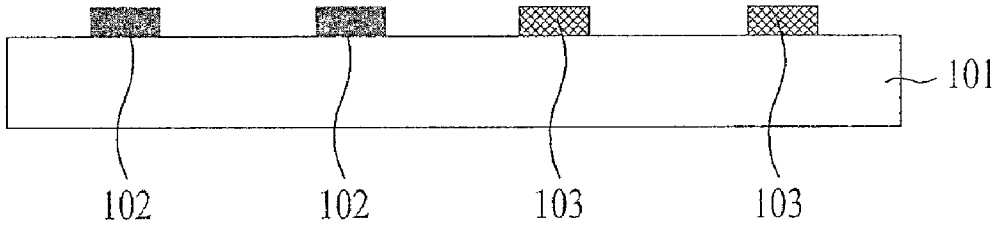
FIGS. 6A to 6J are views illustrating an exemplary embodiment of a method for manufacturing the PDP according to the present invention.

First, a plurality of electrode pairs each including a scan electrode 102 and a sustain electrode 103 are formed on a first substrate 101, in order to prepare the front panel 100, as shown in FIG. 6A.

The front panel 100 is prepared by milling and cleaning a glass or a sodalime glass for a display substrate.

Each electrode pair may be made of ITO. For the electrode pair, metal electrodes may be used.

Preferably, metal electrodes are used. The reason why metal electrodes are used is that the metal electrodes can be more simply and inexpensively manufactured, as compared to ITO electrodes.

If necessary, a bus electrode may be formed on each scan electrode 102 and each sustain electrode 103.

Each electrode pair may be formed in accordance with a photo-etching method using a sputtering process or a lift-off method using a CVD process. The bus electrodes may be made of a material comprising a general-purpose conductive metal and a rare metal.

The general-purpose conductive metal may include aluminum (Al), copper (Cu), nickel (Ni), chromium (Cr), and molybdenum (Mo). On the other hand, the rare metal may include silver (Ag), gold (Au), platinum (Pt), and iridium (Ir).

When the general-purpose conductive metal and rare metal are mixed to prepare the material of the bus electrodes, the general-purpose conductive metal forms a core such that the rare metal encloses the core.

At the left side of the scan electrode 102 in each discharge cell, another scan electrode 102 is arranged. At the right side of the scan electrode 102 in the discharge cell, the sustain electrode 103 of the discharge cell is arranged. At the left side of the sustain electrode 103 in the discharge cell, the scan electrode 102 of the discharge cell is arranged. At the right side of the sustain electrode 103 in the discharge cell, another sustain electrode 103 is arranged.

If necessary, at the left and right sides of the scan electrode 102 in each discharge cell, only the sustain electrodes 103 may be arranged, respectively. At the left and right sides of the sustain electrode 103 in the discharge cell, only the scan electrodes 102 may be arranged, respectively.

The scan electrodes 102 and sustain electrodes 103 are formed such that the distance W between the scan electrode 102 and the sustain electrode 103 in each discharge cell is preferably about 150 to 400 μm.

More preferably, the distance W between the scan electrode 102 and the sustain electrode 103 in each discharge cell is about 300 μm. The distance between the scan electrode 102 and the sustain electrode 103 in each discharge cell may also be about 200 μm.

Figure 6B:
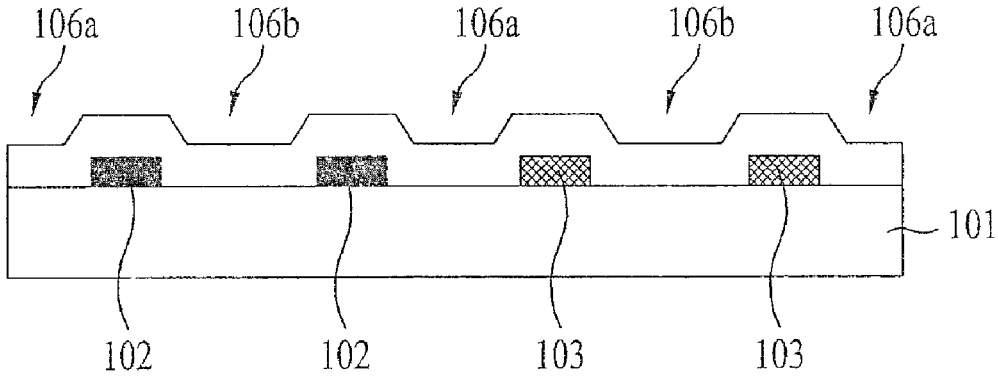

Thereafter, a dielectric layer 104 is formed over the overall surface of the first substrate 101 including the electrode pairs, as shown in FIG. 6B. The dielectric layer 104 is then patterned to form first recesses 106*a* each arranged between two electrodes constituting one electrode pair, and second recesses 106*b* each arranged between two adjacent electrode pairs.

Hereinafter, the process for forming the dielectric layer 104 having the first and second recesses 106*a* and 106*b* will be described in more detail.

First, a first dielectric layer and a second dielectric layer are sequentially formed.

The first dielectric layer comprises dielectric powder, a high-molecular organic compound indissoluble in a developing solution, a dispersing agent, and a plasticizer. The second dielectric layer comprises photosensitive dielectric powder, a high-molecular organic compound dissoluble in a developing solution, a dispersing agent, and a plasticizer.

The high-molecular organic compound dissoluble in a developing solution may be of acryl series.

The first and second dielectric layers may be formed in accordance with a screen printing method, a coating method, or a laminating method using a green sheet.

The second dielectric layer is then developed such that the first dielectric layer is exposed in desired regions. Thus, the first and second recesses 106*a* and 106*b* are formed.

The developing solution may be an alkali aqueous solution or water.

Each of the first and second recesses 106*a* and 106*b* may have various cross-sectional shapes, for example, a taper shape, an arch shape, a rectangular shape, or a stepped shape.

The taper shape is a shape in which the width of the recess decreases linearly as the recess extends upwardly. The arch shape is a shape in which the width of the recess decreases at a gradually-increasing rate as the recess extends upwardly. The rectangular shape is a shape in which the width of the recess is uniform. On the other hand, the stepped shape is a shape in which the width of the recess decreases stepwise.

It is preferred that the width of the second recess 106*b* be larger than the width of the first recess 106*a*.

In this case, it is possible to achieve a reduction in discharge initiation voltage because a discharge path may be formed between the electrodes of adjacent discharge cells, so that an increase in discharge path length is achieved, thereby achieving an enhancement in efficiency and preventing unstable discharge involving self erase, etc.

The width of each of the first and second recesses 106*a* and 106*b* may be smaller than or equal to the distance between two electrodes arranged in each discharge cell or the distance between two electrodes arranged adjacent to each other at opposite sides of the barrier rib of each discharge cell.

Preferably, each of the first and second recesses 106*a* and 106*b* has a maximum depth corresponding to ⅔ of the total thickness of the dielectric layer 104. Each of the first and second recesses 106*a* and 106*b* may have a depth of about 20 to 30 μm.

This is because the dielectric layer 104 cannot perform a desired dielectric function when the recess is excessively deep, thereby causing a reduction in discharge efficiency and a reduction in electrode lifespan.

On the other hand, when the recess is excessively shallow, it is impossible to arrange the scan electrode and the sustain electrode such that the distance between the scan electrode and the sustain electrode is sufficiently long. In this case, it is impossible to achieve a reduction in discharge initiation voltage.

The electrode pairs and the dielectric layer 104 may be cured. In this case, the curing of the electrode pairs and dielectric layer 104 can be achieved in separate processes, respectively, or may be achieved in a single process, to simplify the curing process.

Preferably, the curing temperature is about 500 to 600° C.

Subsequently, a passivation film, which may be made of magnesium oxide (MgO), may be formed over the dielectric layer 104 formed with the first and second recesses 106*a* and 106*b*, in order to relax discharge conditions.

The passivation film functions to protect the dielectric layer 104 from an impact of positive (+) ions during an electrical discharge, while functioning to increase the emission of secondary electrons.

The passivation film is made of magnesium oxide (MgO). The passivation film material may contain silicon, etc. as a dopant. The deposition of the passivation film may be achieved using a CVD method, an e-beam method, an ion plating method, a sol-gel method, or a sputtering method.

Figure 6C:
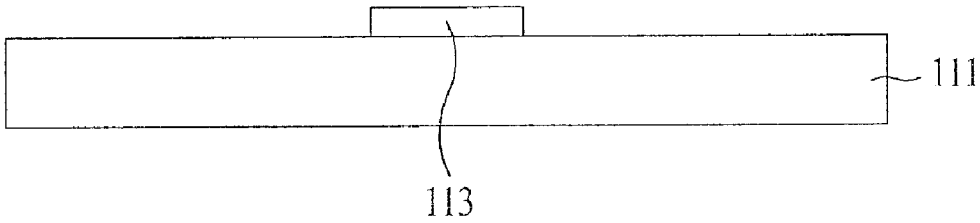

Meanwhile, address electrodes 113 are formed on a second substrate 111 of the back panel 110, as shown in FIG. 6C.

The second substrate 111 may be prepared by machining a glass or a sodalime glass for a display substrate, using milling or cleaning. The address electrodes 113 may be made of silver (Ag), and may be formed in accordance with a screen printing method, a photosensitive paste method, or a photoetching method involving pre-sputtering.

The address electrodes 113 may be formed using a material comprising a general-purpose conductive metal and a rare metal. The detailed process for the formation of the address electrodes 113 is identical to that of the bus electrodes.

Figure 6D:
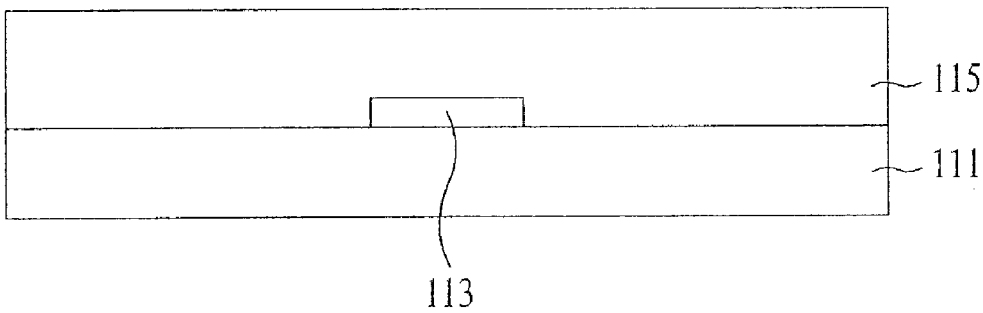

Subsequently, a dielectric layer 115 is formed over the surface of the first substrate 111 formed with the address electrodes 113, as shown in FIG. 6D.

The dielectric layer 115 is formed by depositing a material containing a glass having a low melting point and a filler such as $TiO_2$ in accordance with a screen printing method or a coating method, or by laminating a green sheet. Preferably, the dielectric layer 115 exhibits white, in order to achieve an increase in the brightness of the PDP.

In order to simplify the process, the dielectric layer 115 and address electrodes 113 may be cured in a single process.

Thereafter, barrier ribs 112 are formed to define individual discharge cells.

For the formation of the barrier ribs, a barrier rib material 112*a* is first prepared. The preparation of the barrier rib material 112*a* is achieved by mixing a dispersing agent, a parent glass, and a porous filler with a solvent, and milling the resultant mixture.

The parent glass may include a lead-based parent glass or and a lead-free parent glass. The lead-based parent glass may include ZnO, PbO, or $B_2O_3$. On the other hand, the lead-free parent glass may include ZnO, $B_2O_3$, BaO, SrO, or CaO. The filler may include an oxide such as $SiO_2$ or $Al_2O_3$.

Figure 6E:
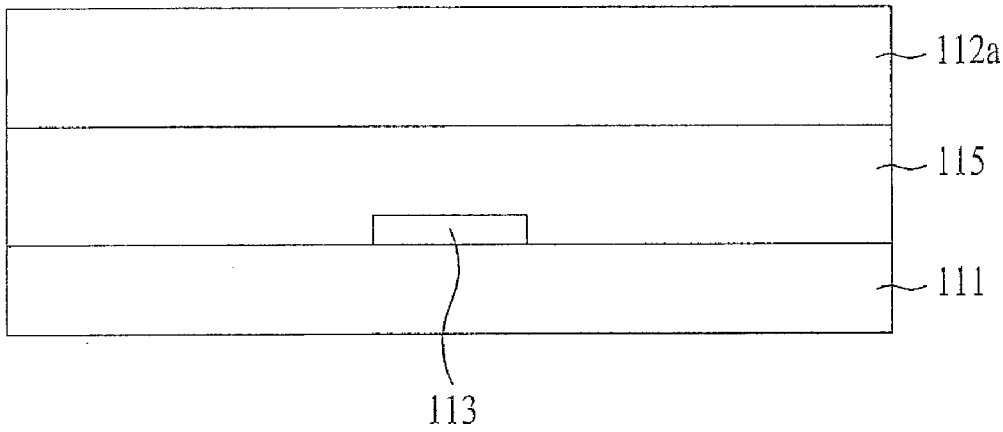

Subsequently, the barrier rib material 112*a* is coated over the dielectric layer 115, as shown in FIG. 6E.

The coating of the barrier rib material 112*a* may be achieved using a spray coating method, a bar coating method, a screen printing method, or a green sheet method. Preferably, a green sheet for the barrier rib material 112*a* is prepared, and is then laminated.

The barrier rib material 112*a* is then patterned. The patterning of the barrier rib material 112*a* may be achieved using a sanding method, an etching method, or a photoresist method. The following description will be given in conjunction with the etching method.

Figure 6F:
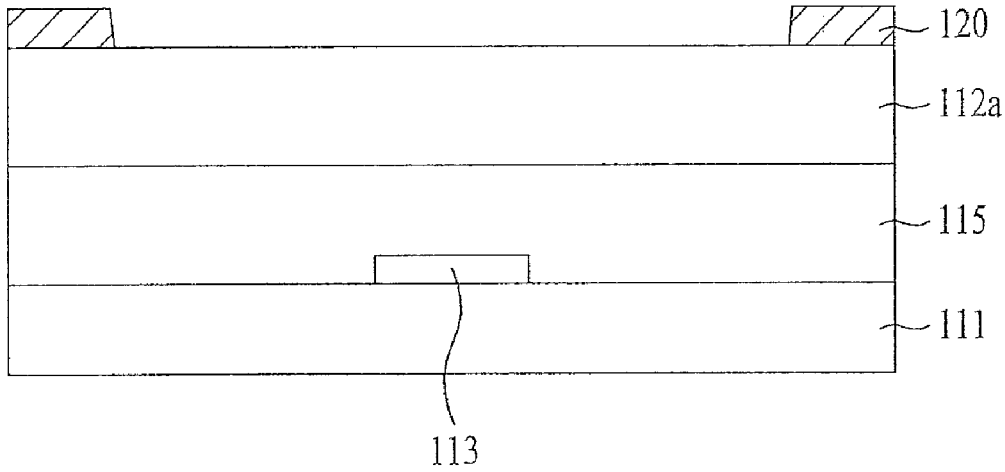

First, dry film resists (DFRs) 120 are formed on the barrier rib material 112*a* such that the DFRs 120 are uniformly spaced apart from one another by a certain distance, as shown in FIG. 6F.

Preferably, the DFRs 120 are formed at positions where barrier ribs will be arranged, respectively.

Figure 6G:
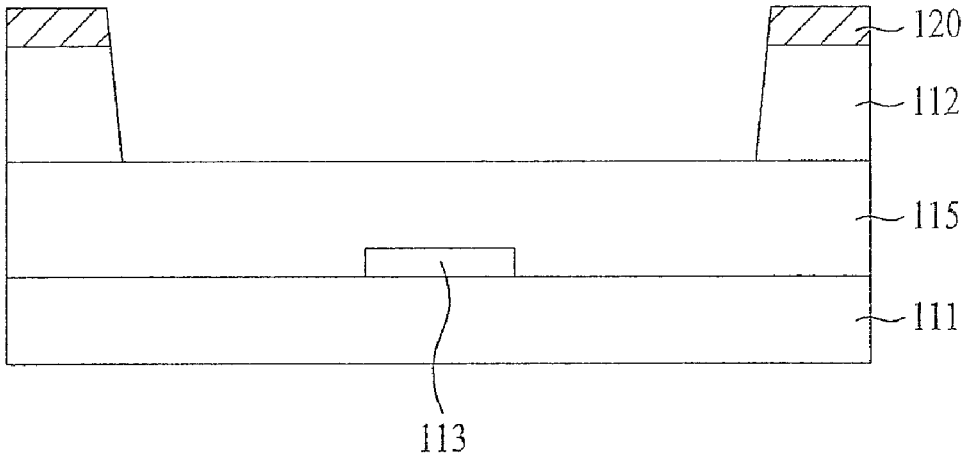

Thereafter, the barrier rib material 112*a* is patterned to form barrier ribs 112, as shown in FIG. 6G.

That is, an etchant is sprayed over the DFRs 120. As a result, the barrier rib material 112*a* is gradually etched in regions where the DFRs 120 are not arranged. Thus, the barrier rib material 112*a* is patterned in the form of the barrier ribs 112.

Figure 6H:
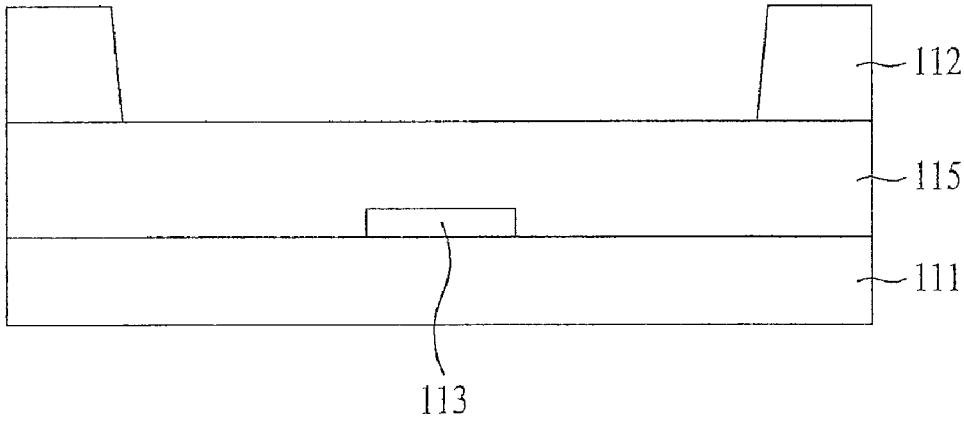

Subsequently, the DFRs 120 are removed. The etchant is then removed in accordance with a rinsing process. A curing process is then carried out. Thus, the barrier ribs 112 are completely formed, as shown in FIG. 6H.

Here, the barrier ribs 112 may be of a stripe type, a well type, or a delta type, as described above.

Figure 6I:
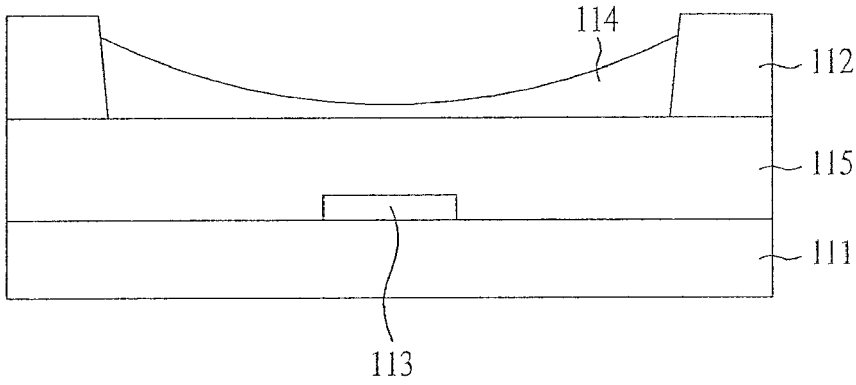

Thereafter, R, G, and B phosphor layers 114 are coated over the surfaces of the back-substrate-side dielectric layer 115 facing discharge spaces and the side surfaces of the barrier ribs 112, as shown in FIG. 6I.

The coating of the phosphor layers 114 is carried out such that R, G, and B phosphors are sequentially coated in respective discharge cells. The coating may be achieved using a screen printing method or a photosensitive paste method.

For all or a part of the discharge cells, the material of each phosphor layer is prepared by mixing a phosphor with a dielectric having a secondary electron emission coefficient higher than that of the phosphor.

Figure 6J:
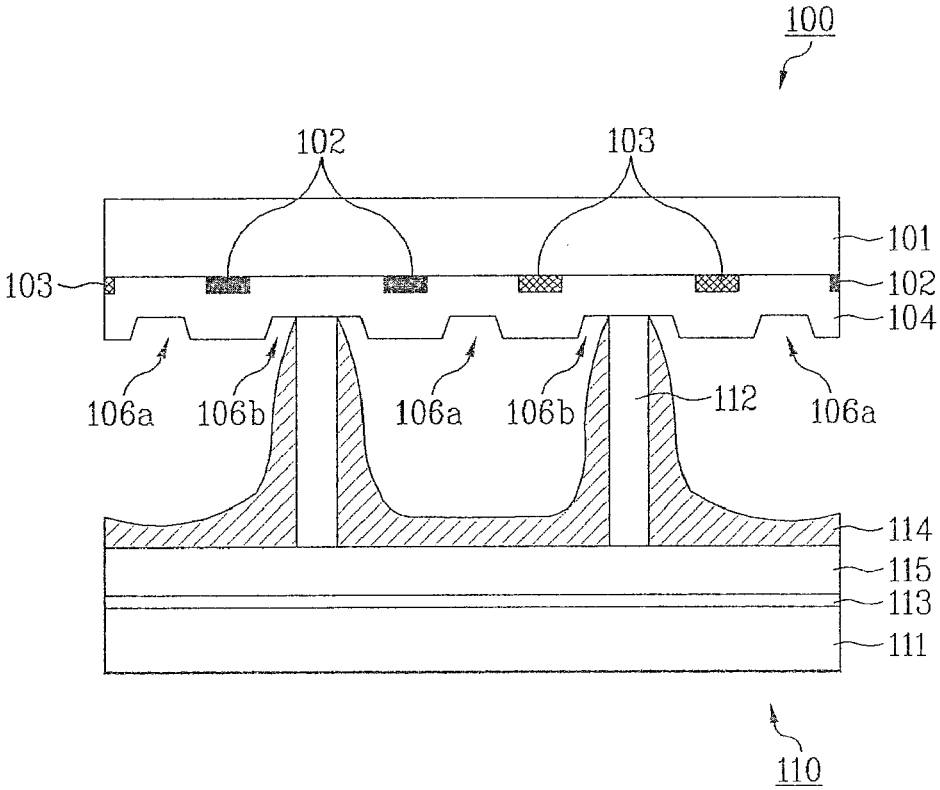

Subsequently, the front panel 100 is assembled to the back panel 110 such that the barrier ribs are interposed between the front and back panels 100 and 110, as shown in FIG. 6J. The front and back panels 100 and 110 are then sealed. The space between the front and back panels 100 and 110 is then evacuated, to remove impurities from the space. Thereafter, a discharge gas is injected into the space.

Now, the sealing process for the front and back panels 100 and 110 will be described in detail.

The sealing process may be achieved using a screen printing method or a dispensing method.

In the screen printing method, a screen having uniformly-spaced patterns is laid on the substrate of one panel. A sealant paste is then applied to the substrate under pressure such that the sealant pate is transferred to the substrate. Thus, a sealant having a desired shape is printed on the panel. This screen printing method has advantages of simple production equipment and a high material use efficiency.

On the other hand, in the dispensing method, a sealant is formed on the substrate by directly applying a thick paste to the substrate by an air pressure, based on CAD data used in the manufacture of a screen mask. The dispensing method has advantages of saving of mask manufacturing costs and a high degree of freedom in the shape of the thick sealant.

Figure 7A:
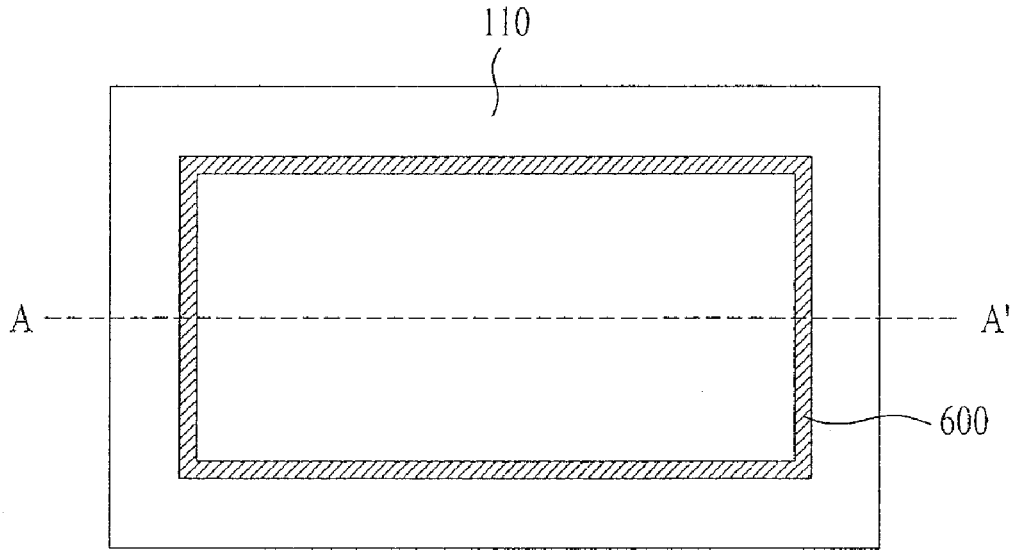
FIG. 7A is a view illustrating the process for assembling front and back panels of the PDP.
Figure 7B:
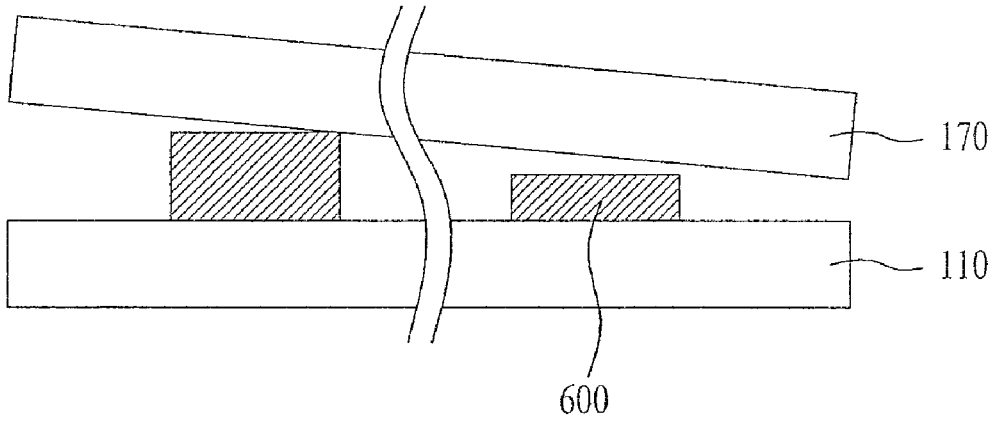
FIG. 7B is a cross-sectional view taken along the line A-A' of FIG. 7A.

FIG. 7A is a view illustrating the process for assembling the front and back panels of the PDP. FIG. 7B is a cross-sectional view taken along the line A-A' of FIG. 7A.

As shown in FIGS. 7A and 7B, a sealant 600 is coated on the front panel 100 or back panel 110.

In detail, the sealant 600 is coated on the front panel 100 or back panel 110 along a region spaced apart from the periphery of the associated panel in accordance with the printing or dispensing method.

The sealant 600 is then cured. In the curing process, organic substances contained in the sealant 600 are removed. Thus, the front panel 100 and back panel 110 are assembled.

Due to the curing process, the sealant 600 may have an increased width and a reduced height.

Although the sealant 600 is coated in accordance with the printing or dispensing method in this embodiment, it may be formed in the form of a sealing tape such that the sealing tape is bonded to the front panel or back panel.

An aging process is then carried out at a certain temperature, to achieve an enhancement in the characteristics of the passivation film, etc.

Subsequently, a front filter may be formed over the front panel. In order to shield electromagnetic interference (EMI) waves emitted from the external of the PDP or to the PDP, the front filter is provided with an EMI shield film.

In order to shield EMI waves while securing a visible ray transmittance required in a display device, the EMI shield film may be formed by patterning a conductive material such that the conductive film has a particular pattern.

The front filter may also be formed with a near infrared ray shielding film, a color correcting film, or an anti-reflection film.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A plasma display panel comprising:

a first panel comprising a plurality of electrode pairs each including a scan electrode and a sustain electrode, and a dielectric layer formed over the electrode pairs;

a second panel comprising a plurality of address electrodes arranged to cross the plurality of electrode pairs; and barrier ribs formed on the second substrate, to define discharge cells, wherein the dielectric layer includes a first recess arranged between two electrodes that are arranged in each discharge cell and a second recess arranged between two electrodes that are arranged adjacent to each other at opposite sides of each barrier rib, wherein the second recess is in contact with an upper surface of the barrier rib, and the second recess arranged between two electrodes arranged adjacent to each other at opposite sides of each barrier rib has a size larger than a size of the first recess arranged between two electrodes arranged in each discharge cell.

2. The plasma display panel according to claim 1, wherein the scan electrode and the sustain electrode in each discharge cell are spaced apart from each other by a distance greater than a distance between the scan electrode and an associated one of the address electrodes.

3. The plasma display panel according to claim 1, wherein the scan electrode and the sustain electrode comprise metal electrodes, respectively.

4. The plasma display panel according to claim 1, wherein the scan electrode and the sustain electrode in each discharge cell are spaced apart from each other by a distance of 150 μm to 400 μm.

5. The plasma display panel according to claim 1, wherein the scan electrode and the sustain electrode in each discharge cell are spaced apart from each other by a distance of 300 μm.

6. The plasma display panel according to claim 1, wherein the scan electrode and the sustain electrode in each discharge cell are spaced apart from each other by a distance of 200 μm.

7. The plasma display panel according to claim 1, wherein the two electrodes arranged in each discharge cell comprise one scan electrode and one sustain electrode.

8. The plasma display panel according to claim 1, wherein the two electrodes arranged adjacent to each other at opposite sides of each barrier rib comprise two scan electrodes alone or two sustain electrodes alone.

9. The plasma display panel according to claim 1, wherein the two electrodes arranged adjacent to each other at opposite sides of each barrier rib comprise one scan electrode and one sustain electrode.

10. The plasma display panel according to claim 1, wherein each of the recesses has a cross-section having one of a taper shape, an arch shape, a rectangular shape, and a stepped shape.

11. The plasma display panel according to claim 1, wherein each of the recesses has a maximum depth corresponding to ⅔ of a total thickness of the dielectric layer.

12. The plasma display panel according to claim 1, wherein each of the recesses has a depth of 20 μm to 30 μm.

13. The plasma display panel according to claim 1, wherein each of the recesses has a width less than or equal to a distance between two electrodes arranged in each discharge cell or a distance between two electrodes arranged adjacent to each other at opposite sides of each barrier rib.

14. A plasma display panel comprising:

a first panel comprising a plurality of electrode pairs each including a scan electrode and a sustain electrode, and a dielectric layer formed over the electrode pairs;

a second panel comprising a plurality of address electrodes arranged to cross the plurality of electrode pairs; and barrier ribs formed on the second substrate, to define discharge cells, wherein the dielectric layer includes a first recess arranged between two electrodes that are arranged in each discharge cell, and a second recess formed between two electrodes arranged adjacent to each other at opposite sides of each barrier rib, and size of the second recess is larger than a size of the first recess, wherein the second recess is in contact with an upper surface of the barrier rib, and the second recess arranged between two electrodes arranged adjacent to each other at opposite sides of each barrier rib has a size larger than a size of the first recess arranged between two electrodes arranged in each discharge cell.

15. A method for manufacturing a plasma display panel, comprising:

preparing a first panel including a plurality of electrode pairs each including a scan electrode and a sustain electrode, and preparing a second panel including address electrodes, barrier ribs defining discharge cells, and phosphor layers;

forming a dielectric layer over the first panel such that the dielectric layer covers the plurality of electrode pairs;

patterning the dielectric layer, to form a first recess between the scan electrode and the sustain electrode of each of the electrode pairs, and to form a second recess between adjacent ones of the electrode pairs; and assembling the first panel and the second panel such that the first recess faces an associated one of the discharge cells, and the second recess faces and associated one of the barrier ribs, wherein the second recess is in contact with an upper surface of the barrier rib, and the second recess arranged between two electrodes arranged adjacent to each other at opposite sides of each barrier rib has a size larger than a size of the first recess arranged between two electrodes arranged in each discharge cell.

16. The method according to claim 15, wherein the dielectric layer has a multilayer structure comprising a first dielectric layer and a second dielectric layer.

17. The method according to claim 16, wherein the first dielectric layer comprises dielectric powder, a high-molecular organic compound indissoluble in a developing solution, a dispersing agent, and a plasticizer.

18. The method according to claim 16, wherein the second dielectric layer comprises photosensitive dielectric powder, a high-molecular organic compound dissoluble in a developing solution, a dispersing agent, and a plasticizer.

19. The method according to claim 18, wherein the high-molecular organic compound dissoluble in a developing solution is of acryl series.

* * * * *